US008443813B2

(12) United States Patent
Boldrini

(10) Patent No.: US 8,443,813 B2
(45) Date of Patent: May 21, 2013

(54) METHOD OF PACKAGING TOBACCO MOLASSES AND A RELATIVE SYSTEM

(75) Inventor: Fulvio Boldrini, Ferrara (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 752 days.

(21) Appl. No.: 12/526,395

(22) PCT Filed: Mar. 20, 2008

(86) PCT No.: PCT/IB2008/000662

§ 371 (c)(1),
(2), (4) Date: Aug. 7, 2009

(87) PCT Pub. No.: WO2008/114132

PCT Pub. Date: Sep. 25, 2008

(65) Prior Publication Data

US 2010/0051041 A1 Mar. 4, 2010

(30) Foreign Application Priority Data

Mar. 20, 2007 (IT) ..... BO2007A0195

(51) Int. Cl.
*A24B 15/12* (2006.01)

(52) U.S. Cl.
USPC ..... 131/375; 131/283; 131/108; 131/109.1; 131/208

(58) Field of Classification Search
USPC ..... 131/283, 375, 108, 109.1, 280
See application file for complete search history.

(56) References Cited

U.S. PATENT DOCUMENTS

| | | | | |
|---|---|---|---|---|
| 2,888,886 | A * | 6/1959 | Jorgenson et al. | 425/101 |
| 3,120,729 | A | 2/1964 | Niepmann | |
| 3,688,468 | A | 9/1972 | Erekson | |
| 5,174,088 | A | 12/1992 | Focke et al. | |
| 7,037,551 | B2 * | 5/2006 | Moore et al. | 426/620 |
| 2003/0113420 | A1 * | 6/2003 | Martin et al. | 426/289 |

FOREIGN PATENT DOCUMENTS

| | | |
|---|---|---|
| CH | 385739 | 12/1964 |
| DE | 2064610 | 7/1972 |
| EP | 0 299 803 | * 1/1989 |
| WO | 93/21066 | 10/1993 |

OTHER PUBLICATIONS

Written Opinion and Search Report of the European Searching Authority dated Aug. 14, 2008 from counterpart PCT application.

* cited by examiner

*Primary Examiner* — Richard Crispino
*Assistant Examiner* — Dionne Walls Mayes
(74) *Attorney, Agent, or Firm* — Timothy J. Klima; Shuttleworth & Ingersoll, PLC

(57) ABSTRACT

A system (1) for portioning and packaging a tobamel smoking mixture (2) comprises a unit (3) internally of which the mixture (2) is prepared by blending tobacco en masse with agglutinants such as honey or molasses, and an extruder unit (17) by which the mixture (2) is shaped into a continuous rod (20).

21 Claims, 4 Drawing Sheets

METHOD OF PACKAGING TOBACCO MOLASSES AND A RELATIVE SYSTEM

This application is the National Phase of International Application PCT/IB2008/000662 filed Mar. 20, 2008 which designated the U.S. and that International Application was published under PCT Article 21(2) in English.

This application claims priority to Italian Patent Application No. BO2007A000195, filed Mar. 20, 2007, and PCT Application No. PCT/IB2008/000662 filed Mar. 20, 2008, which applications are incorporated by reference herein.

TECHNICAL FIELD

The present invention relates to a method for packaging a mixture of tobacco and other substances, used normally with a water pipe.

Known variously as a shisha, or hookah, or narghile, and by other names, the water pipe is an apparatus in which the smoke reaches the mouth of the smoker after being filtered through a vessel filled with liquid, typically perfumed water or such like.

Besides pure tobacco, water pipe smokers also use a mixture known as tobacco molasses, or tobamel. Both terms are utilized in the course of the following specification when referring to the mixture.

BACKGROUND ART

The composition of tobacco molasses or tobamel varies from one region to another but essentially, in addition to tobacco, includes molasses or honey as an agglutinant, in percentages as high as 70%, as well as other oily substances such as glycerine, serving as moisturizing agents, and essences of flowers or fruit as aromatic agents.

Depending on the quantity and nature of the additional substances mixed with the tobacco, these will also determine the density and compactness of the resulting tobacco molasses or tobamel product.

By way of example, the presence of oils tending to solidify at ambient temperature will inevitably render a tobamel mixture somewhat compact.

Whatever the compactness presented by each different kind of mixture, the inclusion of any agglutinating substance, being liquid to a greater or lesser degree, is accompanied by notable drawbacks connected with the operations of blending and packaging portions for use by smokers.

For a tobacco molasses mixture to be successfully retailed, in effect, it must be packaged in special wrappers that will ensure the product stays in perfect condition. The wrap must therefore guarantee absolute airtightness, otherwise the mixture could deteriorate rapidly, with loss of aroma and alteration of its moisture content.

The prior art currently includes a method of packaging tobacco molasses whereby a given quantity of the mixture is rolled out flat and conveyed through special refrigerated tunnels, in such a way that it freezes solid. Once the mixture has hardened, it is cut into single portions or slabs; each of these is then wrapped singly, still frozen, in a respective pack, generally paper.

The solution outlined above presents significant drawbacks, however.

A first drawback is the complexity of the system and the notable amount of energy consumed, given the high cooling power needed in order to bring about the quick freeze required for this type of method.

A second drawback derives similarly from the fact that the tobacco molasses mixture is frozen, inasmuch as the aromatic qualities of the product are always likely to deteriorate.

The object of the present invention is to overcome the drawbacks associated with the prior art, by providing a method of packaging tobacco molasses that will be practical and inexpensive to implement.

A further object of the invention is to provide a system for packaging tobacco molasses that will be suitable for implementing the method disclosed: a system simple and inexpensive in construction, ensuring practicality of use and ease of maintenance.

DISCLOSURE OF THE INVENTION

The stated object is realized in a method according to the present invention, of which the features are recited in the appended claims, particularly claim 1, and any other claim directly or indirectly dependent on claim 1.

The stated object is realized likewise in a system according to the present invention, of which the features are recited in claim 8, and in any other claim directly or indirectly dependent on claim 8.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS OF THE INVENTION

With reference to the accompanying drawings, numeral 1 denotes a system according to the present invention, in its entirety, for packaging tobacco molasses 2.

Figure 1:
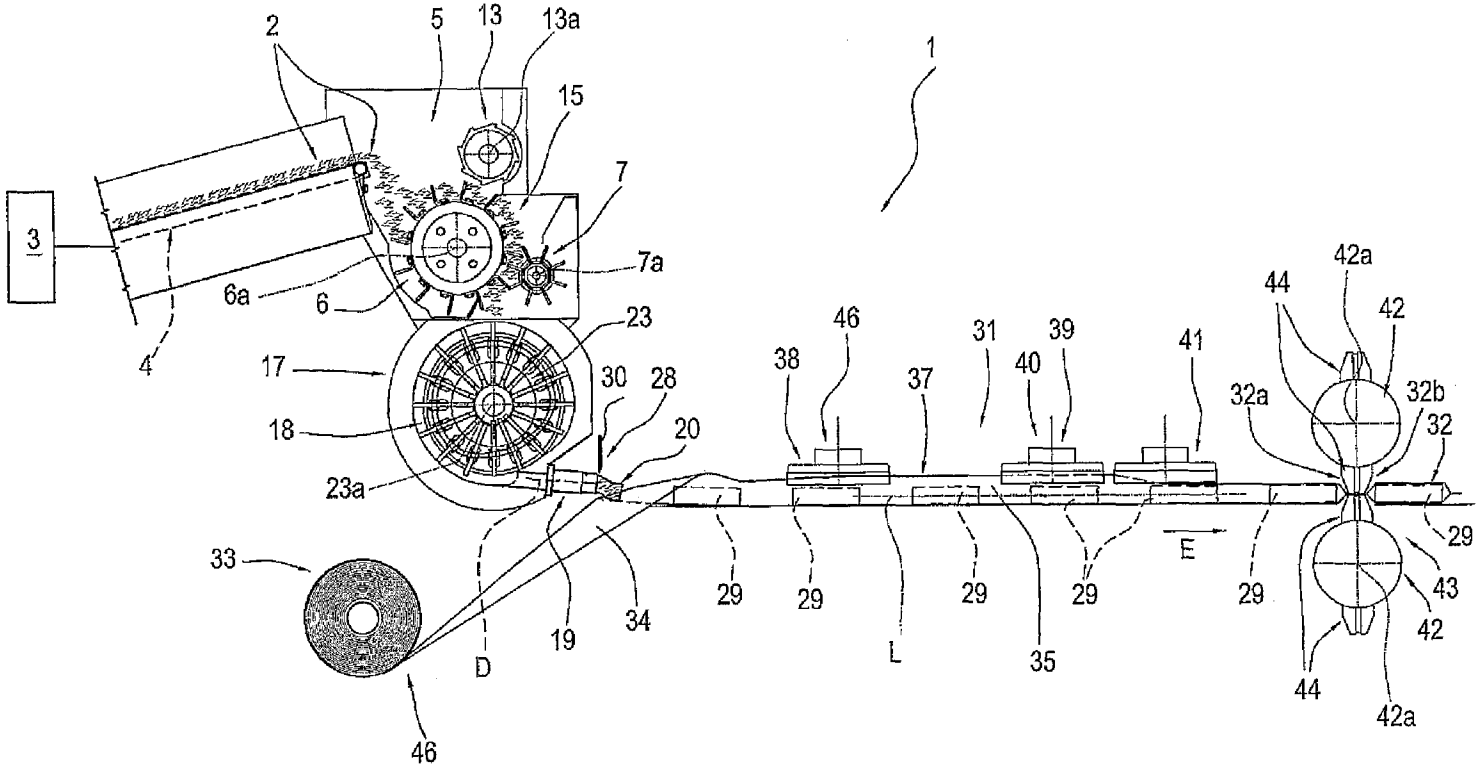
FIG. 1 illustrates a preferred embodiment of a system according to the present invention, viewed schematically in a front elevation and with certain parts omitted better to illustrate others.

As illustrated in FIG. 1, the system 1 comprises a preparation unit, schematized as a block denoted 3, in which tobacco (not illustrated) is blended en masse by substantially conventional methods with agglutinating substances such as honey, molasses or the like, also with other oily substances such as glycerine, serving to moisturize the mixture, and preferably with essences of fruit or flowers serving as aromatizers.

The system 1 comprises a conveying mechanism 4, advantageously of flexible embodiment, on which the tobacco molasses mixture 2 is taken up from the preparation unit 3, and a discharge station 5 where the mixture 2 is released by the conveying mechanism 4.

Figure 2:
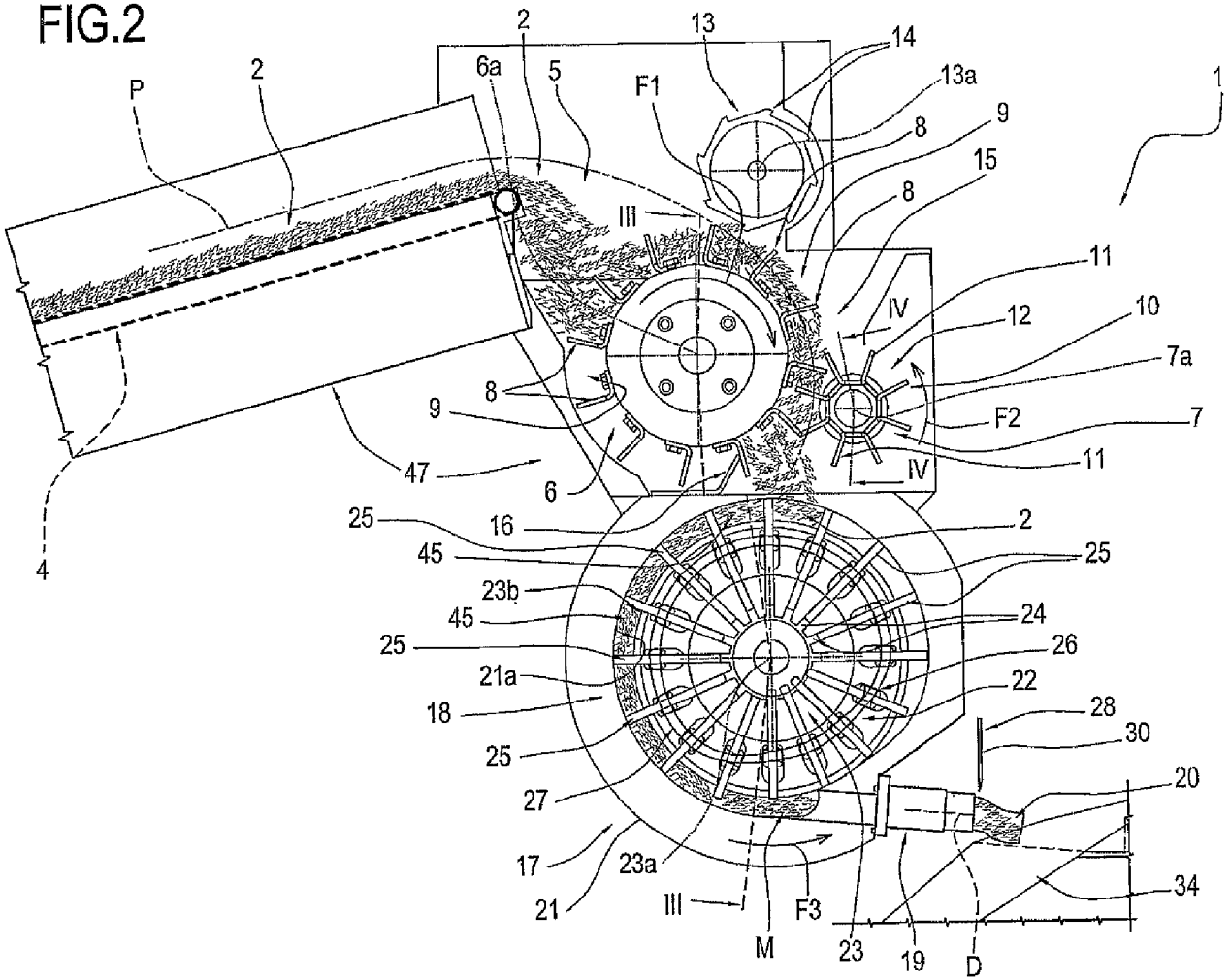
FIG. 2 is an enlarged detail of the system illustrated in FIG. 1.

At a given point downstream of the discharge station 5, as illustrated in FIG. 2, along a feed path P followed by the mixture 2, the system 1 comprises a first transport wheel 6, and a second unloading wheel 7 operating in conjunction with the first wheel 6, as will now be described in detail.

The two wheels 6 and 7 are rotatable about respective axes 6*a* and 7*a* extending mutually parallel and normal to the viewing plane of FIGS. 1 and 2.

The first transport wheel 6 is placed to receive the mixture 2 at the discharge station 5, and comprises a plurality of first finger elements 8 equispaced about a peripheral surface of revolution. Each two adjacent first finger elements 8 combine to delimit a pocket 9 accommodating the mixture 2.

Figure 4:
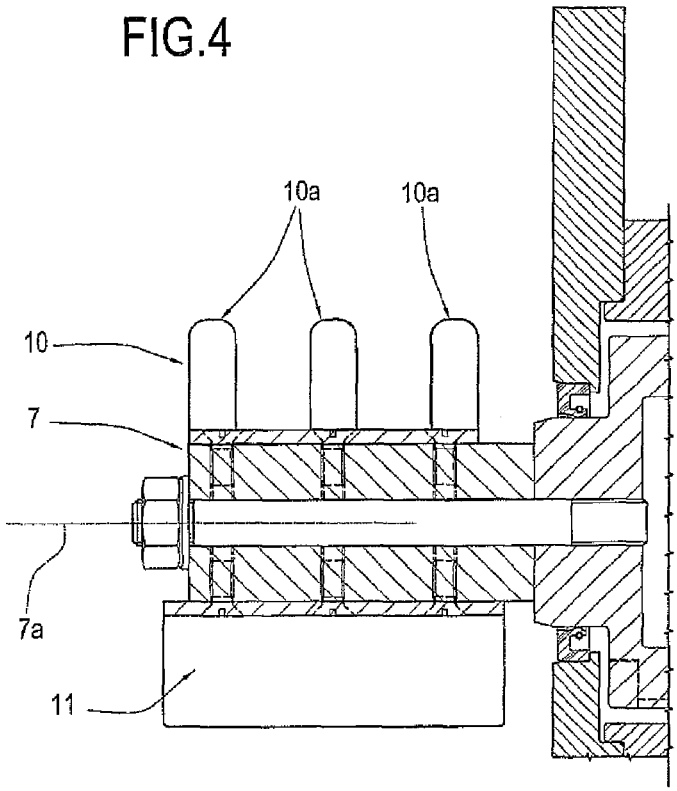
FIG. 4 is a cross section taken on the plane denoted IV-IV in FIG. 2, with certain parts omitted for clarity.

As discernible in FIGS. 2 and 4, the second unloading wheel 7 comprises a plurality of second finger elements 10 equispaced about a peripheral surface of revolution, and a plurality of paddles 11, equispaced likewise about the same peripheral surface; the second finger elements 10 and the paddles 11 combine to establish mechanisms 12 by which the mixture 2 is unloaded from the pockets 9 arranged around the first transport wheel 6.

The second finger elements 10 and the paddles 11 are mounted in alternating succession around the periphery of the second unloading wheel 7.

Also positioned and operating at the discharge station 5 is a third levelling wheel 13, rotatable about a relative axis 13*a* parallel to the axes 6*a* and 7*a* of the first and second wheels 6 and 7. The third wheel 13 presents a plurality of peripheral projections 14 deployed in such a way, when set in rotation, as to distribute and regulate the volume of the mixture 2 occupying the pockets 9 of the first transport wheel 6.

The first and second wheels 6 and 7 are positioned internally of a hopper 15.

A fixed third finger element 16, associated rigidly with the hopper 15, is positioned below the first transport wheel 6. As discernible in FIG. 3, the third finger element 16 is mounted with single members 16*a* offset from the members 8*a* of the first finger elements 8 presented by the first wheel 6, along a direction parallel to the axis 6*a* of the selfsame wheel 6, so that when the first wheel 6 is set in rotation about its axis 6*a*, the members 8*a* of each first finger element 8 will pass through the gaps between the members 16*a* of the fixed third finger element 16.

The system 1 further comprises an extruder unit 17, located beneath the hopper 15 and downstream of the wheels 6 and 7, relative to the feed path P followed by the mixture 2.

The extruder unit 17 provides the system 1 with extruding means, and comprises a device 18 by which the mixture 2 is forced through an outlet orifice denoted 19.

The mixture 2 emerges from the outlet orifice 19 in the form of a continuous rod 20 and advances thereafter in a predetermined direction D.

Figure 3:
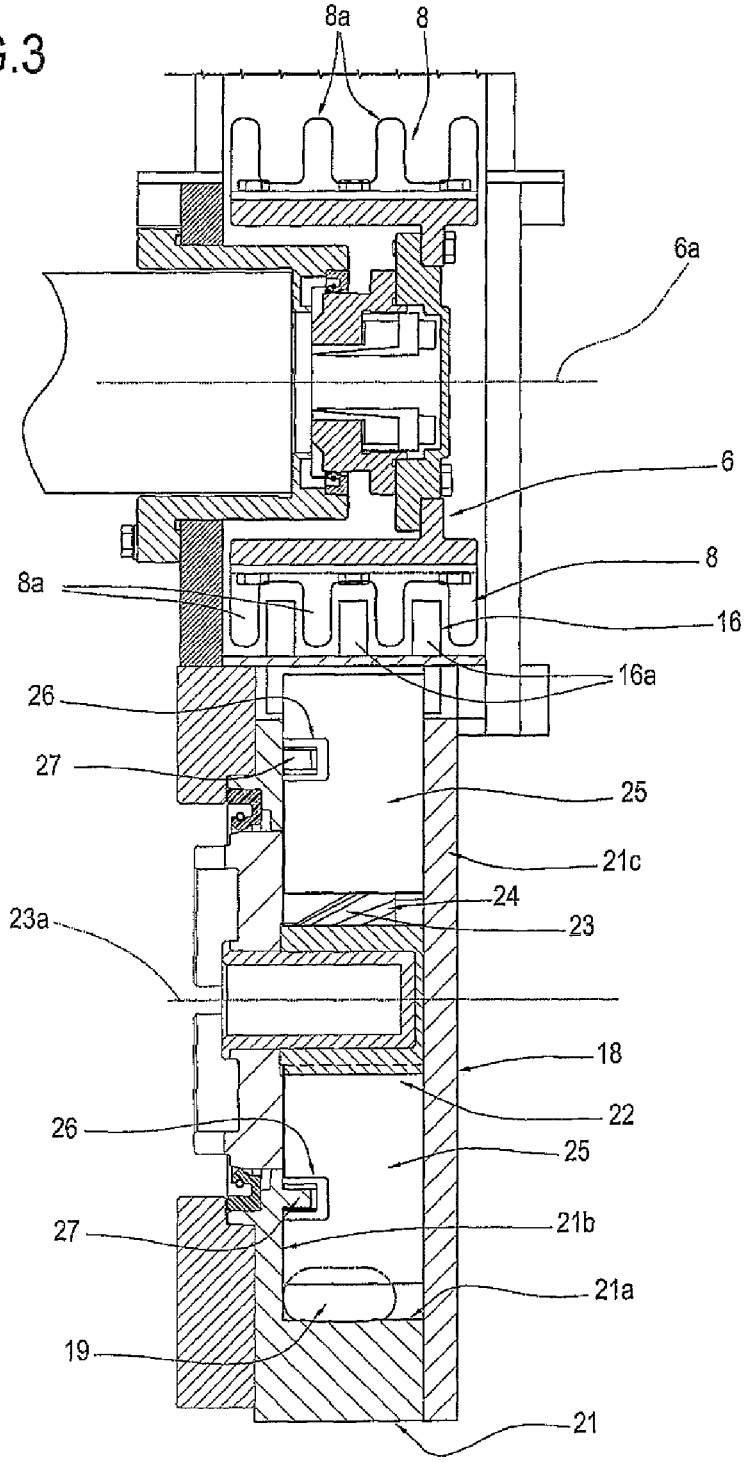
FIG. 3 is a cross section taken on the plane denoted III-III in FIG. 2.

Referring to FIGS. 2 and 3, the forcing device 18 comprises a casing 21 with a cavity delimited by a peripheral wall 21*a*, part of which presents a circular contour.

The cavity afforded by the casing 21 houses a vaned rotor 22 composed of a hub 23 presenting a plurality of radial rectilinear slots 24, and a plurality of vanes 25, each slidably accommodated within a respective slot 24.

Each vane 25 comprises a guide element 26 designed to interact, in the manner of a follower, with a fixed cam 27 presented by a back wall 21*b* of the casing 21.

The hub 23 is rotatable about a respective axis 23*a* parallel to the axes 6*a* and 7*a* of the aforementioned wheels 6 and 7, in such a way that the vanes 25 can be set in rotation and caused, along a predetermined segment of their orbit, to sweep the space existing between the selfsame hub 23 and the peripheral wall 21*a* of the casing 21.

The vanes 25 are caused by the rotation of the hub 23 and the profile of the cam 27 to slide radially in the respective slots 24, according to a predetermined law of motion imposed by the geometry of the cam 27.

As illustrated in FIG. 3, the cam 27 is a positive action type, that is to say, able to control the sliding motion of the vane 25 in both directions allowed by the relative slot 24; in other words, the cam 27 determines the movement of the vane 25 both toward the axis 23*a* of rotation of the hub 23, and away from the selfsame axis.

With reference to FIGS. 1 and 2, the system 1 further comprise a cutter device 28 positioned at the outlet orifice 19, by which the continuous rod 20 of mixture 2 emerging from the selfsame orifice is divided into single portions 29 of predetermined weight and/or volume.

The aforementioned cutter device 28 comprises a blade 30 moving in a plane transverse to the predetermined feed direction D followed by the rod 20 issuing from the outlet orifice 19.

The portions 29 cut from the rod 20 are fed to a wrapping unit 31 by which a sealed wrapper 32 is fashioned around each portion 29 or group of portions.

Referring to FIG. 1, the wrapping unit 31 comprises feed means 33 of familiar type (not illustrated in detail) by which a film 34 of wrap material is directed along a packaging line L and folded around the advancing portions 29 of tobacco mixture 2 to form a tubular envelope 35, and transport means likewise of familiar type, by which the tubular element 35 is advanced together with the single portions 29 of the mixture 2.

The tubular envelope 35 formed by folding the film 34 presents two joined longitudinal edges 37.

Thus, the portions 29 are spaced apart along the packaging line L in such a way that the empty spaces (not denoted by a numeral, but visible in FIG. 1) created between each two successive portions 29 are enclosed likewise by the tubular envelope 35.

The aforementioned transport means comprise a pair of pinch rollers 38 installed above the packaging line L and engaging the joined longitudinal edges 37 of the film 34.

Also installed above the line L, downstream of the pinch rollers 38, is a pair of first sealing rollers 39 by which the two joined longitudinal edges 37 of the tubular envelope 35 are secured one to another.

The first rollers 39 constitute first sealing means 40 used to fashion the tubular envelope 35.

Also illustrated in FIG. 1, downstream of the first sealing rollers 39, are a pair of folding rollers 41, and a pair of second sealing rollers 42 by which the film 34 is sealed transversely.

The second rollers 42 constitute second sealing means 43 utilized in fashioning the tubular envelope 35.

The function of the folding rollers 41 is to flatten the joined and sealed longitudinal edges 37 in a plane parallel to the packaging line L and substantially normal to the viewing plane of FIG. 1.

The second sealing rollers 42, also of familiar type, are rotatable about respective axes 42*a* orthogonal to the packaging line L and equipped each with two heads 44 deployed in such a way that a head of the top roller and a head of the bottom are able to meet cyclically on the packaging line L and produce a transverse seal in the tubular envelope 35.

In applying transverse seals to the tubular envelope 35, the second sealing rollers 42 serve to create individual wrappers 32 for the single portions 29 of tobacco mixture 2. In particular, the second sealing rollers 42 are designed to bond two border areas divided one from another, one area 32*b* on the trailing end of a wrapper 32 positioned downstream, and one area 32*a* on the leading end of a wrapper 32 positioned upstream, relative to the feed direction E along the packaging line L.

In operation, the mixture 2 produced in the preparation unit 3 by blending tobacco en masse with agglutinating substances, typically honey and the like, is fed by the flexible conveying mechanism 4 to the discharge station 5.

The conveying mechanism 4 consists to advantage in a belt, or alternatively a chain (neither of which illustrated in detail), as appropriate for the particular needs of the user.

The mixture 2 is released at the discharge station 5 and drops into the aforementioned pockets 9, which are brought cyclically into alignment with the station 5 as the first wheel 6 rotates.

With each pocket 9 filling in turn, as described above, and the third levelling wheel 13 also set in rotation, the quantity of the mixture 2 effectively deposited in the pockets 9 is regulated by the projections 14 of the third wheel; in other words, the action of the third wheel 13 is designed to ensure that the single pockets 9 will not be overfilled with the mixture 2.

As the first wheel 6 rotates in the direction of the arrow denoted F1, accordingly, with the successive pockets 9 filled and substantially levelled by the action of the third wheel 13, each pocket enters the hopper 15 and is brought into engagement with the second unloading wheel 7.

The second wheel 7 rotates in the direction of the arrow denoted F2, that is to say, in the opposite direction to the first wheel 6, and is equipped with second finger elements 10 and paddles 11 arranged in alternating sequence around the periphery, as mentioned previously.

As the first wheel 6 rotates, the second wheel 7 rotates synchronously in such a manner that when a pocket 9 filled with the mixture 2 is at a given distance from the second wheel 7, one of the paddles 11 presented by this same wheel will sweep the pocket 9 clear and cause the mixture 2 to drop by gravity.

Each pocket 9 containing the mixture 2 is delimited by two first finger elements 8, one leading and one trailing in the direction of rotation F1 of the wheel 6.

As the two wheels 6 and 7 continue to rotate synchronously, the first finger element 8 on the trailing side of the pocket 9 cleared by the paddle 11 will engage a relative second finger element 10, so that this too assists further in emptying the mixture 2 from the pocket 9.

In like manner to the configuration described previously for the fixed third finger element 16, the second finger elements 10 are mounted with single members 10*a* offset from the members 8*a* of the first finger elements 8 presented by the first wheel 6, along a direction parallel to the axis 6*a* of the selfsame wheel 6, so that when the wheels 6 and 7 are set in rotation about their axes 6*a* and 7*a* the respective finger elements 8 and 10 will cross, with the members 8*a* of each first finger element 8 passing through the gaps between the members 10*a* of a respective second finger element 10. The paddles 11 of the second wheel 7, conversely, never come into contact with the first finger elements 8 of the first wheel 6.

Still referring to FIG. 2, the mixture 2 dropping from the pocket 9 falls to the bottom of the hopper 15, which is open, and down into the extruder unit 17.

The aforementioned flexible conveying mechanism 4, discharge station 5 and wheels 6 and 7 combine to provide means 47 by which the tobacco molasses mixture 2 is transferred from the preparation unit 3 to the extruder unit 17.

The extruder unit 17, to reiterate, provides the system 1 with means by which to extrude the tobacco molasses mixture 2.

In detail, the mixture falls into compartments 45, each delimited by an outer circumferential wall 23*b* of the hub 23, by two successive vanes 25 and by the peripheral wall 21*a* of the casing 21, as well as by the back wall 21*b* and by a cover 21*c* substantially parallel to the back wall, illustrated only in FIG. 3.

Filled with the tobacco mixture 2, the compartments 45 rotate as one with the hub 23 in the direction of the arrow denoted F3, advancing to a point immediately upstream of the extruder outlet orifice 19.

Approaching the outlet orifice 19, the vanes 25 are caused by the interaction of the cam 27 and the guide elements 26, each rigidly associated with a relative vane, to slide radially in the respective slots 24 toward the axis of rotation 23*a* of the hub 23.

Owing to this radial displacement of the vanes 25, the successive advancing compartments 45 are caused to open up partially, with the result that a mass M of the tobacco molasses mixture is able to form gradually on the inlet side of the outlet orifice 19.

Exposed to the driving action of the vanes 25 located upstream, relative to the direction of rotation F3, the mass M of tobacco mixture is forced through the outlet orifice 19 and extruded thus into a continuous rod 20.

As the rotor 22 continues to turn in the direction of rotation F3, the vanes 25 will be distanced from the axis of rotation 23*a* of the hub 23 by the action of the cam 27, resuming a position of proximity to the peripheral wall 21*a*. The radial motion induced in the vanes by the geometry of the cam 27 corresponds to a predetermined law of motion.

On emerging from the outlet orifice 19, the extruded rod 20 is cut into single portions 29 by the action of the blade 30, which is illustrated schematically in the accompanying drawings.

With reference to FIG. 2, the blade 30 is capable of reciprocating motion in a plane substantially perpendicular to the viewing plane, timed in relation to the angular motion of the rotor 22 in such a way that successive strokes made through the continuous rod 20 of tobacco molasses will produce portions 29 of predetermined and substantially repeatable weight and/or volume.

In other words, with the rotor 22 turning on its axis, each successive step through a given angular distance will be accompanied by a respective cut through the rod 20.

As already described in part, the portions 29 cut from the rod 20 are fed to the wrapping unit 31, and in particular, released at the moment of the cutting stroke onto the film 34 of wrap material supplied by the feed means 33.

The feed means 33 and the pinch rollers 38 combine in substantially conventional manner to fashion the film 34 into a tube and thus form the aforementioned envelope 35, with the joined longitudinal edges 37 extending above the portions 29.

Accordingly, the feed means 33 and pinch rollers 38 combine to provide wrapping means 46 by which the product is enveloped in the film 34 of wrap material.

The wrapping unit 31 further comprises means (not illustrated) by which to advance the tubular envelope 35 and the cut portions 29 along the packaging line L; such means will be of substantially familiar embodiment, and designed to carry the tubular envelope 35 and the portions 29 forward as one.

Once beyond the pinch rollers 38, in effect, the single portions 29 of tobacco mixture 2 will remain positioned internally of the tubular envelope 35 with the longitudinal edges 37 of the tube joined together.

These same edges are thereupon secured one to another, advantageously by means of a heat seal, as they pass between the first sealing rollers 39.

Thus, on emerging from the first sealing rollers 39, the sealed edges 37 appear as a longitudinal raised seam, standing erect on the tubular envelope 35, which is then flattened down against the envelope 35 by the folding rollers 41.

Passing subsequently between the second sealing rollers 42, the tubular envelope 35 is bonded by seals applied in a direction transverse to that of the packaging line L.

These transverse seals, applied to the tubular envelope 35 containing the single portions 29 ordered equidistantly one from the next, serve to define and complete the individual wrappers 32.

The operation of the first and second sealing means 40 and 43 and of other components making up the wrapping unit 31 is not described in detail in the present specification, being substantially familiar to a person skilled in the art field of packaging, albeit applied to different types of products.

To advantage, the aforementioned film 34 of wrap material will be a heat-sealable material.

In an alternative embodiment of the present invention (not illustrated), the blade 30 of the cutter device could be made capable of movement along the feed direction D of the continuous rod 20 and thus translatable as one with the rod during the cutting stroke by which successive portions 29 are separated.

The problems associated with the prior art are overcome by the present invention, and the objects stated at the outset duly realized.

The invention claimed is:

1. A system for packaging a tobacco molasses mixture, comprising:

a preparation unit in which tobacco is blended en masse at least with agglutinating substances, an extruding mechanism by which the mixture is formed into a continuous rod;

a transfer mechanism by which the tobacco molasses mixture is transferred from the preparation unit to the extruding mechanism, wherein the transfer mechanism comprises:

a flexible conveying mechanism on which the mixture advances, a discharge station at which the mixture is released from the flexible conveying mechanism, a first transport wheel by which the mixture is taken up at the discharge station and fed to the extruding mechanism, the first transport wheel comprising a plurality of first finger elements arranged around a peripheral surface of revolution, each delimiting a respective pocket in which the mixture is collected, and a second unloading wheel interacting with the first wheel and having unloading mechanisms by which the mixture is removed from the pockets of the first wheel.

2. A system as in claim 1, wherein the extruding mechanism comprises comprise an outlet orifice by which the rod of tobacco molasses is shaped, and a device by which the mixture is directed forcibly through the outlet orifice.

3. A system as in claim 2, wherein the forcing device comprises a rotor equipped with vanes.

4. A system as in claim 3, wherein the vanes of the rotor are displaceable radially according to a predetermined law of motion.

5. A system as in claim 4, wherein the vanes of the rotor interact with a cam by which the displacement of the vanes is induced according to a predetermined law of motion.

6. A system as in claim 5, wherein the cam is a positive action cam.

7. A system as claim 2 comprising a cutter device positioned at the outlet orifice, by which the continuous rod of tobacco molasses mixture is divided into portions of at least one chosen from predetermined weight and volume.

8. A system as in claim 7, wherein the continuous rod of tobacco molasses mixture issuing from the outlet orifice is caused to advance in a predetermined feed direction, and the cutter device comprises a blade moving in a plane substantially transverse to the predetermined feed direction.

9. A system as in claim 8, wherein the blade moves parallel to the predetermined feed direction.

10. A system as in claim 7, comprising a wrapping unit by which the portions of tobacco mixture are packaged.

11. A system as in claim 10, wherein the wrapping unit comprises a wrapping mechanism by which the single portions of the mixture are wrapped initially in an envelope of film wrap material presenting a tubular shape with two joined longitudinal edges.

12. A system as in claim 11, comprising an advancing mechanism by which the tubular envelope and the portions contained therein are caused to advance along a packaging line.

13. A system as in claim 12, comprising a first sealing mechanism by which the joined longitudinal edges are secured one to another.

14. A system as in claim 13, comprising a second sealing mechanism by which the tubular envelope is bonded transversely in such a way as to enclose each portion within a relative individual sealed wrapper.

15. A system as in claim 1, wherein the flexible conveying mechanism comprises a conveyor belt.

16. A system as in claim 1, wherein the flexible conveying mechanism comprises a transport chain.

17. A system as in claim 1, wherein the unloading mechanisms comprise a plurality of second finger elements arranged around the periphery of the second wheel, positionally offset from and interengageable with the first finger elements of the first wheel in such a way as to detach residual mixture from the selfsame first finger elements.

18. A system as in claim 17, wherein the unloading mechanisms comprise a plurality of paddles arranged around the periphery of the second wheel.

19. A system as in claim 18, wherein the second finger elements and the paddles are arranged in alternating sequence one with another around the periphery of the second wheel.

20. A system as in claim 1, comprising a fixed third finger element positionally offset from and interengageable with the first finger elements of the first wheel in such a way as to detach residual mixture from the first finger elements.

21. A system as in claim 1, comprising a third leveling wheel positioned at the discharge station and regulating the volume of mixture released into each pocket of the first wheel.

* * * * *